US008867971B2

(12) United States Patent
Inoue et al.

(10) Patent No.: US 8,867,971 B2
(45) Date of Patent: Oct. 21, 2014

(54) DEVELOPER REGULATOR, DEVELOPMENT DEVICE, AND IMAGE FORMING APPARATUS INCORPORATING SAME

(75) Inventors: Ryuji Inoue, Hyogo (JP); Yuji Nagatomo, Osaka (JP); Yasuhide Matsuno, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 329 days.

(21) Appl. No.: 13/209,764

(22) Filed: Aug. 15, 2011

(65) Prior Publication Data

US 2012/0045254 A1 Feb. 23, 2012

(30) Foreign Application Priority Data

Aug. 17, 2010 (JP) ..... 2010-182431

(51) Int. Cl.
*G03G 15/08* (2006.01)

(52) U.S. Cl.
CPC .... *G03G 15/0812* (2013.01); *G03G 2215/0866* (2013.01)
USPC ..... 399/284

(58) Field of Classification Search
CPC ..... G03G 15/0812; G03G 2215/0866
USPC ..... 399/274, 284
See application file for complete search history.

(56) References Cited

U.S. PATENT DOCUMENTS

| | | | | |
|---|---|---|---|---|
| 4,395,110 | A * | 7/1983 | Hosono et al. | 399/284 |
| 5,552,867 | A * | 9/1996 | Sekino et al. | 399/284 |
| 5,602,631 | A * | 2/1997 | Sakaguchi | 399/284 |
| 7,835,652 | B2 | 11/2010 | Konishi et al. | |
| 7,865,118 | B2 | 1/2011 | Nakagawa et al. | |
| 7,890,033 | B2 | 2/2011 | Murayama et al. | |
| 7,945,195 | B2 | 5/2011 | Inoue et al. | |
| 2003/0235438 | A1 * | 12/2003 | Tatsumi | 399/284 |
| 2010/0028057 | A1 | 2/2010 | Yamada et al. | |

FOREIGN PATENT DOCUMENTS

| | | |
|---|---|---|
| JP | 4-234776 | 8/1992 |
| JP | 2000-338779 | 12/2000 |
| JP | 2007-57883 | 3/2007 |
| JP | 2007-57910 | 3/2007 |

* cited by examiner

*Primary Examiner* — David Gray
*Assistant Examiner* — Thomas Giampaolo, II
(74) *Attorney, Agent, or Firm* — Oblon, Spivak, McClelland, Maier & Neustadt, L.L.P.

(57) ABSTRACT

A developer regulator to restrict an amount of a developer, including a base portion; an intermediate portion continuous with the base portion, the intermediate portion having a flat area on one face, the flat area having a roughened surface; and a distal end continuous with the intermediate portion, the distal end being bent relative to the base portion in a direction opposite the one face in which the flat area is formed.

11 Claims, 4 Drawing Sheets

DEVELOPER REGULATOR, DEVELOPMENT DEVICE, AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2010-182431, filed on Aug. 17, 2010, in the Japan Patent Office, the entire disclosure of which is hereby incorporated herein by reference.

BACKGROUND OF THE INVENTION

1. Field of the Invention

The present invention generally relates to a developer regulator for restricting amount of developer on a developer bearer, a development device including the developer bearer and the developer regulator, and an image forming apparatus such as a copier, a printer, a facsimile machine, a plotter, or a multifunction machine capable of at least two of these functions that includes the development device.

2. Description of the Background Art

In general, electrophotographic image forming apparatuses, such as copiers, printers, facsimile machines, or multifunction devices including at least two of those functions, etc., include a latent image carrier on which an electrostatic latent image is formed and a development device to develop the latent image with developer. In development devices, a configuration in which amount of the developer carried on a developer bearer is adjusted to a suitable value by a developer regulator, and then the developer whose amount is adjusted is carried to a developing region facing a latent image carrier, is widely used.

As a developer regulator, a regulator blade formed of a resin, an elastic material, or a metal plate is widely used. A regulator blade 200 includes a bent point 200*b* near a distal end 200*a* side as shown in FIG. 1, as proposed for example in JP-2007-57883-A, JP-2007-57910-A, and JP-2000-338779-A. In this example, when toner (as the developer) carried on a development roller 300 passes a position facing the bent point 200*b* of the regulator blade 200 by rotating the development roller 300, and the toner is formed into a thin layer. As illustrated in FIG. 2, the amount of toner to be carried to the developing region is adjustable depending on a bending angle θ formed by the bent point 200*b* of the regulator blade 200 and a length A between a tip of the regulator blade 200 and the bent point 200*b* thereof. The amount of toner is restricted by a vicinity of an apex of an outer edge of the bent point 200*b*.

However, in this example in which the bent point 200*b* is provided in the regulator blade 200, a contact pressure to contact the regulator blade 200 to a surface of the development roller 300 focuses on the apex of the outer edge of the bent point 200*b*, which increases the friction between the development roller and the regulator blade and causes the development roller 300 and the regulator blade 200 to abrade. As a result, it is difficult to maintain the toner layer on the development roller restricted by the regulator blade at a consistent thickness over time.

In order to alleviate the abrasion at the bent point, it is conceivable that a contact pressure between the regulator blade and the development roller is reduced. However, when the contact pressure is reduced, the charging ability of the toner is reduced as well, with concomitant imaging failure such as black spots in the background of the image.

Alternatively, when the toner charging ability is increased so as to prevent the occurrence of black spots, fluctuation in usage environment (toner amount of the development roller) and in durability of the development roller becomes larger over time.

SUMMARY OF THE INVENTION

The present invention provides an improved developer regulator capable of preventing developer from remaining on the developer bearer and from adhering to the developer regulator, as well as preventing the developer regulator from abrading while increasing charging ability of the developer on the developer bearer, without decreasing a contact pressure between the developer regulator and the developer bearer.

In one exemplary embodiment of the present invention, a developer regulator to restrict an amount of a developer, includes a base portion, an intermediate portion continuous with the base portion, the intermediate portion having a flat area on one face, the flat area having a roughened surface, and a distal end continuous with the intermediate portion, the distal end being bent relative to the base portion in a direction opposite the one face in which the flat area is formed.

In another exemplary embodiment, a development device to develop a latent image on an image carrier with developer includes a development bearer to bear and transport the developer to the image carrier; and a developer regulator, provided at a position facing the development bearer, to restrict the amount of the developer borne on the developer bearer. The developer regulator includes a base portion; an intermediate portion continuous with the base portion, the intermediate portion having a flat area on one face facing the surface of the developer bearer, the flat area having a roughened surface; and a distal end continuous with the intermediate portion, the distal end being bent relative to the base portion in a direction opposite the one face in which the flat area is formed.

In yet another exemplary embodiment, an image forming apparatus includes an image carrier to bear a latent image, and the above-described development device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
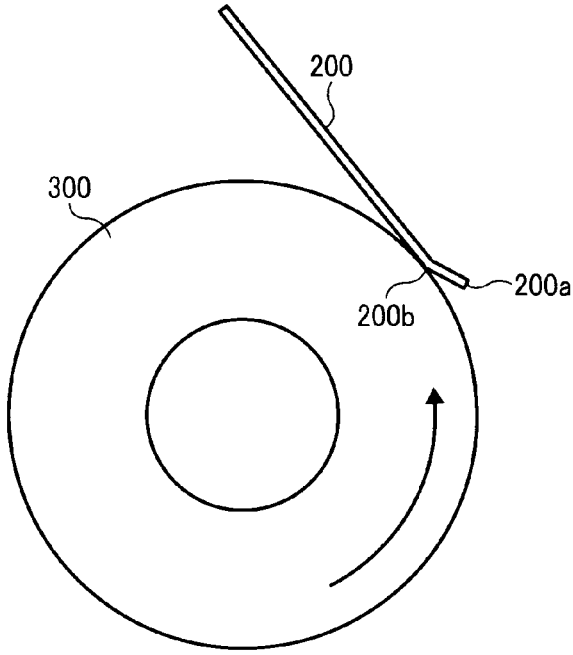
FIG. 1 PRIOR ART
FIG. 1 is a schematic view of a related art regulator blade and a development roller.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

The above-described image forming operation forms the full-color toner image on the recording sheet P. Alternatively, the image forming apparatus 100 may form a monochrome toner image by using one of the four process units 1Y, 1C, 1M, and 1Bk, or may form a two-color toner image or a three-color toner image by using two or three of the four process units 1Y, 1C, 1M, and 1Bk.

Figure 2:
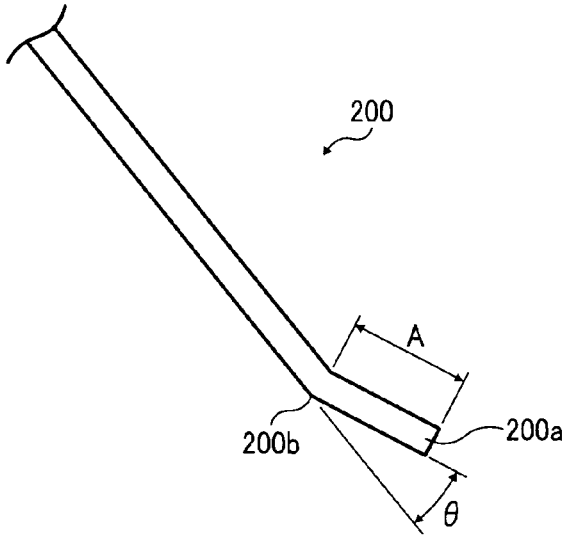
FIG. 2 PRIOR ART
FIG. 2 is an enlarged view of the related art regulator blade shown in FIG. 1.

Referring now to the drawings, wherein like reference numerals designate identical or corresponding parts throughout the several views, particularly to FIG. 2, an image forming apparatus 100 according to example embodiments is described.

It is to be noted that the suffixes Y, M, C, and K indicate only that components indicated thereby are used for forming yellow, magenta, cyan, and black images, respectively, and hereinafter may be omitted when color discrimination is not necessary.

Figure 3:
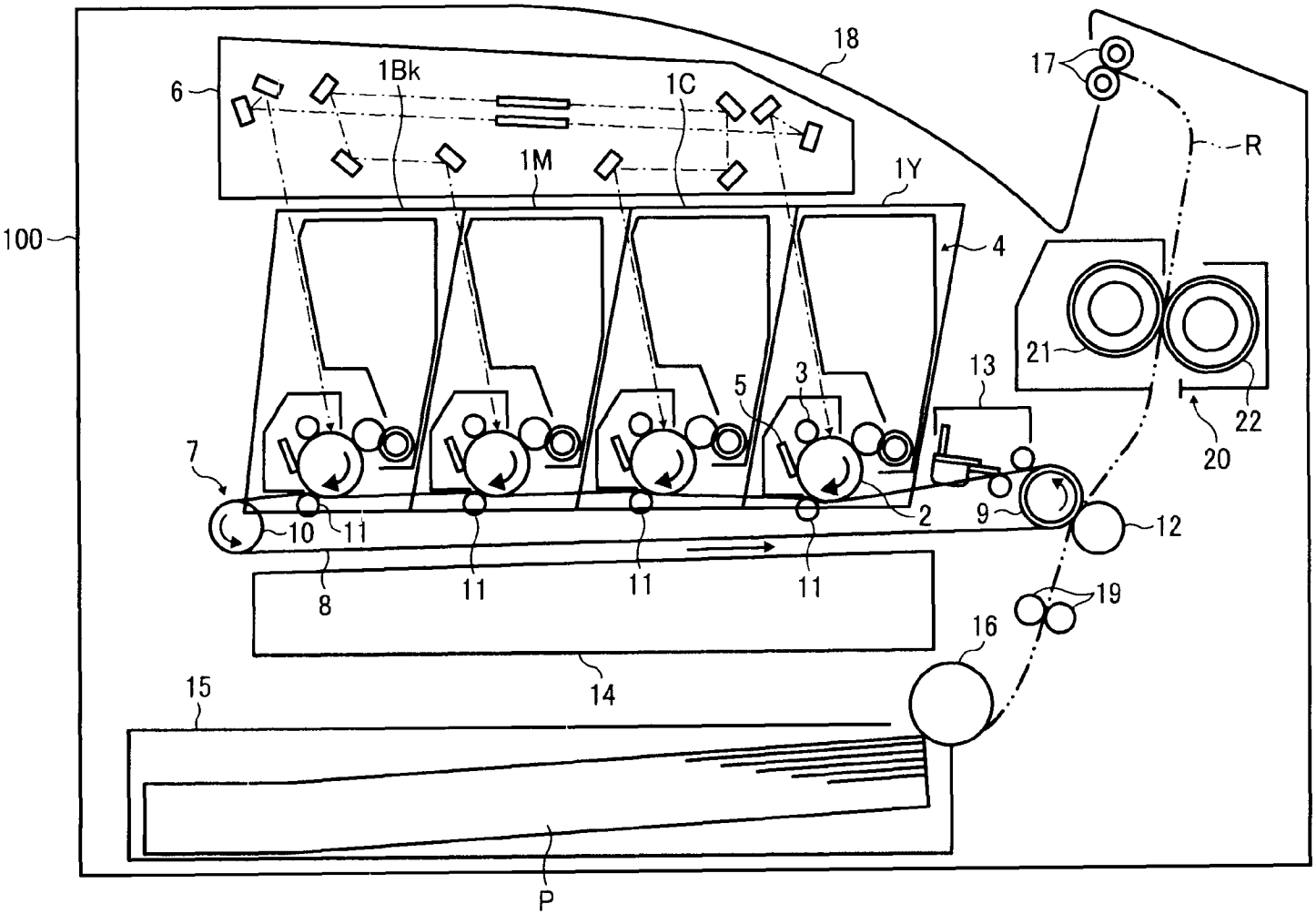
FIG. 3 is a schematic diagram illustrating a configuration of an image forming apparatus according to an illustrative embodiment of the present invention.

FIG. 3 is a schematic view of the image forming apparatus 100. As illustrated in FIG. 3, the image forming apparatus 100 may be a copier, a facsimile machine, a printer, a multifunction printer having at least one of copying, printing, scanning, plotter, and facsimile functions, or the like. The image forming apparatus 100 may form a color image and/or a monochrome image by electrophotography. According to the example embodiments, the image forming apparatus 100 is a copier for forming a color image on a recording medium by electrophotography.

As illustrated in FIG. 3, the image forming apparatus 100 includes process units 1Y, 1C, 1M, and 1Bk, an exposure device 6, a transfer device 7, a second transfer roller 12, a belt cleaner 13, a waste toner container 14, a paper tray 15, a feed roller 16, an output roller pair 17, an output tray 18, a registration roller pair 19, a fixing device 20, and a conveyance path R. The process unit 1Y includes a photoconductive drum 2, a charging roller 3, a development device 4, and a cleaning blade 5. The transfer device 7 includes an intermediate transfer belt 8, a driving roller 9, a driven roller 10, and first transfer rollers 11. The fixing device 20 includes a fixing roller 21, a pressing roller 22, and separators 23.

The four process units 1Y, 1C, 1M, and 1Bk are detachably attached to the image forming apparatus 100. The process units 1Y, 1C, 1M, and 1Bk contain and use toners in different colors (e.g., yellow, cyan, magenta, and black colors corresponding to color separation components of a color image), respectively, but have a similar structure. Accordingly, the following describes the structure of the process unit 1Y which is equivalent to the structure of the process units 1C, 1M, and 1Bk.

In the process unit 1Y, the photoconductive drum 2 (e.g., a photoconductor) serves as an image carrier for carrying an electrostatic latent image. The charging roller 3 serves as a charger for charging a surface of the photoconductor 2. The development device 4 serves as a development device for supplying developer (e.g., toner) to the surface of the photoconductor 2. The cleaning blade 5 serves as a cleaner for cleaning the surface of the photoconductor 2. It is to be noted that, for ease of description, reference numerals 2, 3, 4, and 5 are assigned to the photoconductor, the charging roller, the development device, and the cleaning blade, respectively, in the process unit 1Y for yellow, but are omitted in the process unit 1C, 1M, and 1Bk in FIG. 1.

The exposure device 6 is provided above the process units 1Y, 1C, 1M, and 1Bk, and serves as an electrostatic latent image formation member for exposing the charged surfaces of the photoconductors 2. The exposure device 6 includes a light source, a polygon mirror, f-lens, and a reflection mirror, and emits a laser light to a surface of the respective photoconductors 2 based on image data.

The transfer device 7 is provided below the process units 1Y, 1C, 1M, and 1Bk. In the transfer device 7, the intermediate transfer belt 8, that is, an endless belt serving as a transfer member, is stretched over the driving roller 9 and the driven roller 10, and moves and rotates in a rotation direction. The four first transfer rollers 11, serving as first transfer members, are disposed opposite the four photoconductors 2 of the process units 1Y, 1C, 1M, and 1Bk, respectively. The first transfer rollers 11 contact an inner circumferential surface of the intermediate transfer belt 8, and press against the photoconductors 2 via the intermediate transfer belt 8 to form first transfer nips between the photoconductors 2 and the intermediate transfer belt 8 at positions at which the photoconductors 2 contact the intermediate transfer belt 8, respectively. In addition, the primary transfer bias roller 11 is connected to a power source, and a predetermined direct current (DC) and/or alternate current (AC) is applied to the primary transfer roller 11. The second transfer roller 12, serving as a second transfer member, is disposed opposite the driving roller 9. The second transfer roller 12 contacts an outer circumferential surface of the intermediate transfer belt 8, and presses against the driving roller 9 via the intermediate transfer belt 8 to form a second transfer nip between the second transfer roller 12 and the intermediate transfer belt 8 at a position at which the second transfer roller 12 contacts the intermediate transfer belt 8. Similarly to the primary transfer roller 11, the secondary transfer bias roller 12 is connected to a power source, and a predetermined direct current (DC) and/or alternate current (AC) is applied to the secondary transfer roller 12.

The belt cleaner 13 faces the outer circumferential surface of the intermediate transfer belt 8 at a right end of the intermediate transfer belt 8 in FIG. 3, and cleans the outer circumferential surface of the intermediate transfer belt 8.

A waste toner conveyance hose extending from the belt cleaner 13 is connected to an inlet of the waste toner container 14 provided below the transfer unit 7 to connect the belt cleaner 13 to the waste toner container 14.

The paper tray 15 and the feed roller 16 are provided in a lower portion of the image forming apparatus 100. The paper tray 15 contains recording sheets P serving as recording media. The feed roller 16 feeds the recording sheets P one by one from the paper tray 15. A recording sheet P fed from the paper tray 15 is conveyed toward the output tray 18 via the output roller pair 17 provided on top of the image forming apparatus 100. The output roller pair 17 discharges the recording sheet P onto an outside of the image forming apparatus 100, that is, onto the output tray 18. The output tray 18 stocks the recording sheets P fed by the output roller pair 17. The conveyance path R is provided inside the image forming apparatus 100 to guide the recording sheet P from the paper tray 15 to the output tray 18. The registration roller pair 19 is provided between the feed roller 16 and the second transfer roller 12 in the conveyance path R.

The fixing device 20 is provided in the conveyance path R at a position downstream from the second transfer roller 12 and upstream from the output roller pair 17 in a recording medium conveyance direction. The fixing device 20 fixes a toner image on the recording sheet P. The fixing device 20 includes the fixing roller 21 serving as a fixing member heated by a heat source, the pressing roller 22 serving as a rotary pressing member or an opposing member disposed opposite the fixing roller 21, and the separators 23. The pressing roller 22 presses against the fixing roller 21 to form a fixing nip N between the fixing roller 21 and the pressing roller 22. The separators 23 separate the recording sheet P from the fixing roller 21.

Referring to FIG. 3, the following describes an image forming operation of the image forming apparatus 100. When the image forming apparatus 100 receives a command to start an image forming operation, a driver drives and rotates the photoconductors 2 of the process units 1Y, 1C, 1M, and 1Bk, respectively, clockwise in FIG. 3. In the process units 1Y, 1C, 1M, and 1Bk, the charging rollers 3 uniformly charge the surfaces of the photoconductors 2 to have a given polarity, respectively.

The exposure device 6 emits laser beams onto the charged surfaces of the photoconductors 2 to form electrostatic latent images on the surfaces of the photoconductors 2 according to image data corresponding to yellow, cyan, magenta, and black colors generated by separating full-color image data, respectively.

The development devices 4 supply yellow, cyan, magenta, and black toners to the electrostatic latent images formed on the photoconductors 2 to make the electrostatic latent images visible as yellow, cyan, magenta, and black toner images, respectively.

A driver drives and rotates the driving roller 9 counterclockwise in FIG. 3 to move and rotate the intermediate transfer belt 8 in the rotation direction. A voltage controlled to have a constant voltage or current of a polarity opposite a polarity of the toners is applied to the first transfer rollers 11 so as to generate a transfer electric field at the first transfer nips between the first transfer rollers 11 and the photoconductors 2, respectively. The transfer electric field generated at the first transfer nips transfers the yellow, cyan, magenta, and black toner images formed on the photoconductors 2 of the process units 1Y, 1C, 1M, and 1Bk, respectively, onto the outer circumferential surface of the intermediate transfer belt 8 in such a manner that the yellow, cyan, magenta, and black toner images are superimposed on a same position on the intermediate transfer belt 8 sequentially. Thus, a full-color toner image is formed on the outer circumferential surface of the intermediate transfer belt 8.

The cleaning blades 5 remove residual toners remaining on the surfaces of the photoconductors 2 from the surfaces of the photoconductors 2 after the yellow, cyan, magenta, and black toner images are transferred from the photoconductors 2 onto the intermediate transfer belt 8, respectively.

Dischargers discharge the surfaces of the photoconductors 2 to initialize a surface potential of the photoconductors 2 so that the photoconductors 2 are ready for a next image forming operation.

The feed roller 16 rotates and feeds a recording sheet P contained in the paper tray 15 toward the registration roller pair 19 in the conveyance path R. The registration roller pair 19 feeds the recording sheet P toward the second transfer nip formed between the second transfer roller 12 and the driving roller 9 disposed opposite the second transfer roller 12 via the intermediate transfer belt 8 at a proper time.

A transfer voltage having a polarity opposite the polarity of the toners forming the full-color toner image formed on the intermediate transfer belt 8 is applied to the second transfer roller 12 so as to generate a transfer electric field at the second transfer nip between the second transfer roller 12 and the intermediate transfer belt 8. The transfer electric field generated at the second transfer nip transfers the full-color toner image formed on the intermediate transfer belt 8 onto the recording sheet P at a time.

The recording sheet P bearing the full-color toner image is sent to the fixing device 20. When the recording sheet P bearing the full-color toner image passes through the fixing nip N between the fixing roller 21 and the pressing roller 22, the fixing roller 21 and the pressing roller 22 apply heat and pressure to the recording sheet P to melt and fix the full-color toner image on the recording sheet P. The recording sheet P bearing the fixed full-color toner image is separated from the fixing roller 21 by the separators 23, and is sent to the output roller pair 17 so that the output roller pair 17 outputs the recording sheet P onto the output tray 18. The belt cleaner 13 removes residual toner remaining on the intermediate transfer belt 8 from the intermediate transfer belt 8 after the full-color toner image is transferred onto the recording sheet P. The removed toner is sent and collected into the waste toner container 14.

The above-described image forming operation forms the full-color toner image on the recording sheet P. Alternatively, the image forming apparatus 100 may form a monochrome toner image by using one of the four process units 1Y, 1C, 1M, and 1Bk, or may form a two-color toner image or a three-color toner image by using two or three of the four process units 1Y, 1C, 1M, and 1Bk.

Figure 4:
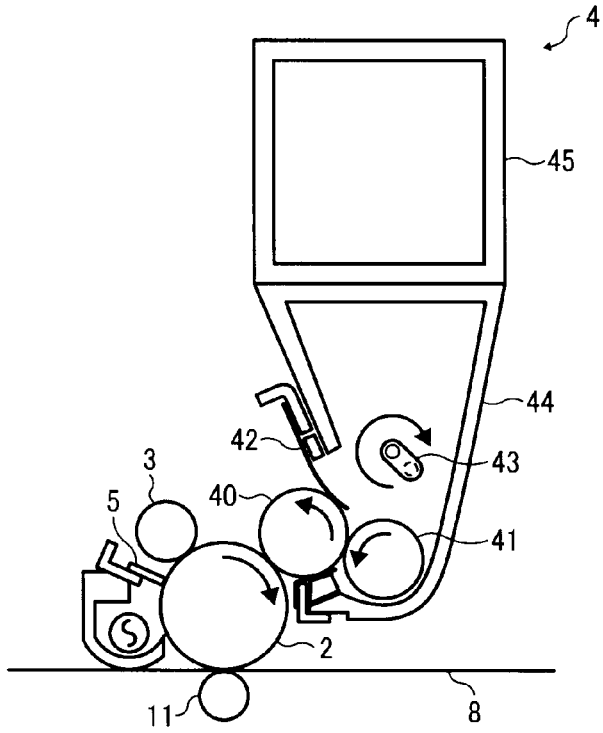
FIG. 4 illustrates a schematic view of a development device including a regulator blade and a development roller, included in the image forming apparatus shown in FIG. 3.

Referring to FIG. 4, the following describes a structure of the development device 4. FIG. 4 illustrates a schematic view of the development device 4.

As illustrated in FIG. 4, the development device 4 is housed in a development housing 44 and a toner container 45 to contain a toner functioning as a developer supplied to the development housing 44. The development housing 44 includes a development roller 40, a supply roller 41, a regulator blade 42, and an agitator 43. The development roller 20 functions as a developer bearer to bear and transport the developer. The supply roller 41 functions as a developer supplier to supply the developer to the development roller 40. The regulator blade 42 functions as a developer regulator to restrict amount of the developer on the development roller 40.

The toner container 45 is detachably attached to a top of the development housing 44, and the toner container 45 and the development housing 44 constitute a development unit.

The supply roller 41 is formed by a sponge roller that includes a metal core and a sponge portion, including a foam-polyurethane semi-electrically conducted by mixing carbon, wrapped around the metal core. In the supply roller 41 of the present embodiments, a diameter (ϕ) of the metal core is 6 mm, an external diameter (ϕ) of the sponge portion is 12 mm, and a nip width between the supply roller 41 and the development roller 40 is 2 mm, and a ratio of rotation between the supply roller 41 and the development roller 40 is 1.

The development roller 40 includes a metal core formed of a metal such as SUS steel and an elastic body including urethane robber or silicon lubber wrapped around the metal core. The elastic body is adjusted to have a resistance value of within a range from $10^5\Omega$ to $10^7\Omega$ using an electrically conductive material. In the development roller 40 of the present embodiments, rubber hardness is 75 Hs, a diameter (ϕ) of the metal core is 6 mm, and an external diameter (ϕ) of rubber is 12 mm.

The regulator blade 42 is formed of a metal plate, such as SUS, whose thickness is 0.1 mm, and an area near a tip of the regulator blade 42 contacts the surface of the development roller 40, which are described further detail later.

The operation of the above-constituted development device 4 is described below.

Initially, the toner contained in the development housing 44 is agitated by the agitator 43, which supplies the development roller 40 by the supply roller 41.

Then, the development roller 40 rotates and transports the toner carried on its circumferential surface to a pressing portion (contact position) facing the regulator blade 42, and the toner carried on the development roller 40 is spread to a thin film with rotation of the development roller 40 by passing the pressing portion.

Subsequently, the development roller 40 transports the toner carried on its circumferential surface to a development r area facing the photoconductor drum 11, where the toner is selectively attracted to an image portion of the photoreceptor 2, and then the latent image is visualized as a toner image.

Control of the toner amount on the development roller 40 is important for stabilizing development. Ordinarily, a contact pressure (usual liner pressure 20-60 N/m) and a contact nip position that is a position at which the regulator blade contacts the development roller (an area inboard from the tip of the blade to approximately 0.5±0.5 mm) are strictly controlled, and are determined depending on the characteristics of the toner to be used, the development roller, and the supply roller, as appropriate.

In the present embodiments, the regulator blade 42 is formed of SUS steel whose thickness is 0.1 mm, linear pressure is 45 N/m, the nip position is a position 0.1 mm inboard from the tip, and a length (free length) from a support end to a free end (tip) of the regulator blade 42 is 14 mm. With this configuration, the toner layer can be formed to a stable, consistent thickness on the development roller 40.

First Embodiment

Figure 5:
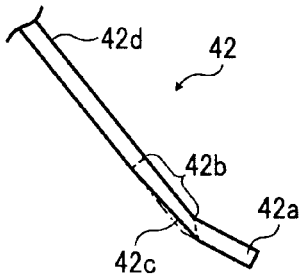
FIG. 5 is an enlarged view of the regulator blade shown in FIG. 4.
Figure 6:
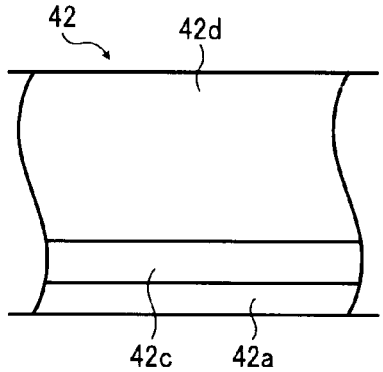
FIG. 6 is a diagram illustrating the regulator blade shown in FIG. 5 viewed from a contact side of the development roller.

FIG. 5 is an enlarged view of the regulator blade 42, functioning as a developer regulator. FIG. 6 is a diagram illustrating the regulator blade 42 viewed from a contact side of the development roller 40. As illustrated in FIG. 5, the regulator blade 42 includes a base portion 42*d*, the distal end 42*a*, and an intermediate portion 42*b* continuous with the base portion 42*d* and the distal end 42*a*. In FIGS. 5 and 6, the base portion 42*d* that is attached to the development housing 44 (support end) is at the top and the distal end 42*a* side (free end) is at the bottom. The intermediate portion 42*b* provided close to the distal end 42*a* is bent upward relative to the base portion 42*d* at a predetermined angle. A flat area 42*c* having a flat face is provided in a lower face of the intermediate portion 42*b* of the regulator blade 42, such that the flat area 42*c* in the intermediate portion 42*b* contacts the development roller 40. That is, the regulator blade 42 includes the base portion 42*d*, the intermediate portion 42*b* continuous with the base portion 42*d* having the flat area 42*c* on one face, and a distal end 42*a* continuous with the intermediate portion 42*b* that is bent relative to the base portion 42*d* in a direction opposite the one face in which the flat area 42*c* is formed.

In manufacturing the regulator blade 42 of the present embodiment, the regulator blade 42 including a bent point (see FIG. 1) is set in to an abrasion device that includes a polishing roll of the same hardness as the development roller 40 and having a surface coated with an abrasive soap. Subsequently, the contact face (lower face) of the intermediate portion 42*b* of the regulator blade 42 is ground by the rotating polishing roll, thus forming the flat area 42*c*.

Figure 7:
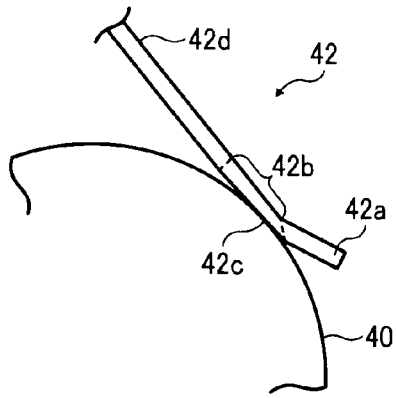
FIG. 7 is an enlarged view illustrating the regulator blade and the development roller in a state in which the regulator blade contacts the development roller.

FIG. 7 is an enlarged view illustrating the regulator blade 42 and the development roller 40 in a state in which the regulator blade 42 contacts the development roller 40. As illustrated in FIG. 7, the flat area 42*c* of the regulator blade 42 contacts the development roller 40. Since the flat area 42*c* of the regulator blade 42 contacts and presses against the development roller 40, the contact pressure at the regulator blade 42 is dispersed, thus alleviating the abrasion of the pressing portion of the regulator blade 42.

Herein, the inventors of the present disclosure carried out a print durability test for comparing a regulator blade of a comparative example that does not have a flat area and the regulator blade 42 having the flat area 42*c* to the intermediate portion 42*b*, and measured the changes of the toner amount on the development roller 40 under conditions of low temperature and low humidity.

Figure 8:
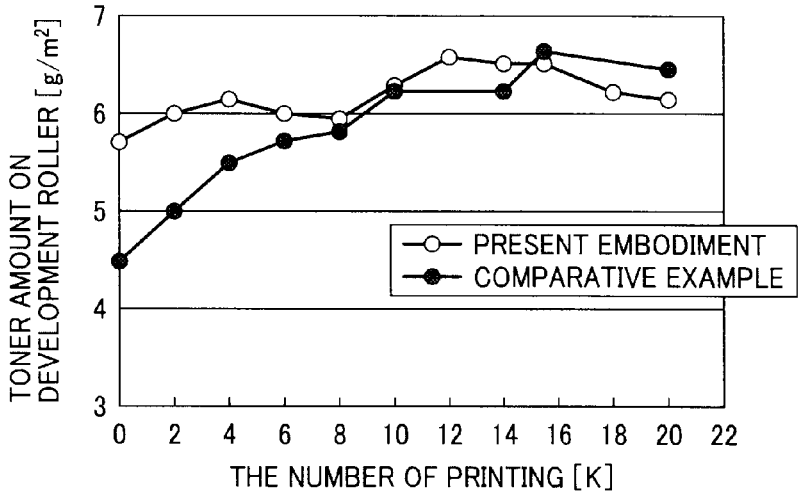
FIG. 8 is a measurement result of print durability test using the regulator blade shown in FIG. 5 and the comparative example of the regulator blade shown in FIG. 2.

FIG. 8 shows correlations between amount of toner on the developer and number of printings. In FIG. 8, the vertical axis is a number of printing (k number) and the horizontal axis is amount of toner (g/m) on the development roller 40.

As shown in FIG. 8, as compared with the regulator blade according to the comparative example, when the regulator blade 42 of the present embodiment is used, the amount of the toner is stable even when the number of printing increases. This is because it can be assumed that the abrasion of the pressing portion between the regulator blade 42 and the development roller 40 is reduced, and as a result, the fluctuation in the thickness of the toner layer restricted by the regulator blade 42 can be reduced as well. In other words, in the regulator blade 42 of the present embodiment, by resisting the abrasion of the regulator blade, the toner layer on the development roller can be maintained at a predetermined thickness.

Second Embodiment

Next, regulator blade 42-1 according to a second embodiment is described below with reference to FIGS. 9A and 9B.

Figure 9A:
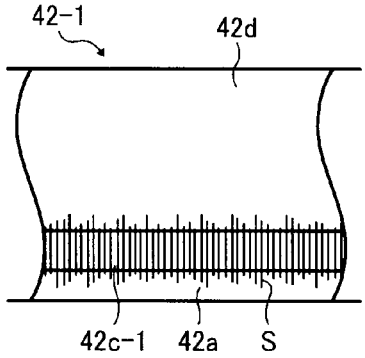
FIG. 9A is a view of a regulator blade according to another embodiment of the present invention when viewed from a contact side of the development roller.

FIG. 9A is a view of the regulator blade 42-1 when viewed from a contact side of the development roller 40. FIG. 9B is an enlarged view illustrating a main portion of the regulator blade 42-1. In the present embodiment of FIG. 9, a flat area 42*c*-1 of the regulator blade 42-1 is roughened by forming multiple grooves S. Other configuration is similar to the first embodiment.

The flat area 42*c*-1 is deliberately abraded. This abrasion can be carried out as follows: In manufacturing the regulator blade 42-1 of the present embodiment, the flat area 42*c* is formed in the regulator blade 42 by the above-described abrasion device. After that, a grindstone roller whose external diameter is greater than that of the development roller 40 scrapes the flat area 42*c*-1 to form the multiple parallel grooves S extending in a direction C in which the surface of the development roller 40 is moved (hereinafter "surface movement direction C"), that is, a rotary direction of the development roller 40 on the flat area 42*c*-1.

The effect of this abrasion may be described as follows: If the flat area has a smooth surface unlike the present embodiment, additives separated from the toner and toner particles whose external diameters are small may remain in a portion upstream from the development roller from the pressing portion of the regulator blade, which may causes the additives and the small toner particles to adhere to the development roller 40.

By contrast, in the configuration in which the flat area 42*c*-1 is roughened as in the present embodiment, retaining the small toner particles and the additives on the development roller 40 can be prevented, which can avoid adhesion of the small toner particles and additives thereon.

Herein, when the print durability test using the regulator blade 42-1 was measured under conditions of high temperature and high humidity, the adhesion of the small toner particles and additives did not occur.

In addition, in the present embodiment, differing from a comparative example in which the regulator blade contacts a development roller at a point (instead of in a line or over a two-dimensional area), the regulator blade 42-1 linearly contacts the development roller 40 because the surface of the regulator blade 42-1 is roughened by forming the grooves, which can have greater resistance to abrasion of the regulator blade 42-1.

Third Embodiment

Next, a regulator blade 42-2 according to a third embodiment is described below with reference to FIGS. 10A and 10B.

Figure 10A:
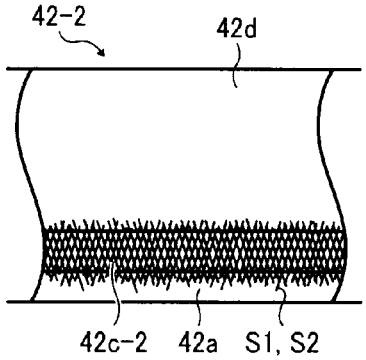
FIG. 10A is a view of a regulator blade according to yet another embodiment of the present invention when viewed from a contact side of the development roller.

FIG. 10A is a view of the regulator blade 42-2 when viewed from contact side of the development roller 40. FIG. 10B is an enlarged view illustrating a main portion of the regulator blade 42-2. In the present embodiment shown in FIGS. 10A and 10B, a flat area 42*c*-2 is roughened by forming multiple grooves S1 and S2 that intersect with each other thereon. Other configuration is similar to the embodiments describe above.

Figure 10B:
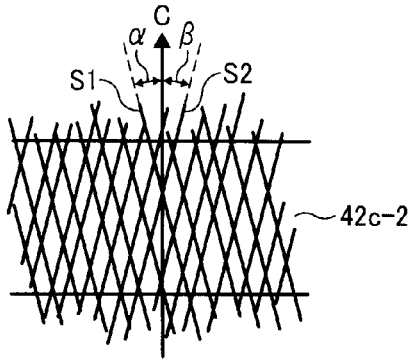
FIG. 10B is an enlarged view illustrating a main portion of the regulator blade shown in FIG. 10A.

As illustrated in FIG. 10B, a first set of multiple oblique grooves S1 extending at an angle A relative to the surface movement direction C (rotary direction) and a second set of multiple oblique grooves S2 intersecting with the first multiple grooves S1 and extending at an angle B relative to the surface movement direction C are formed on the flat area 42*c*-2 (angle B is an opposite side to the angle A relative the surface movement direction C).

In manufacturing the regulator blade 42-2 of the present embodiment, the flat area 42*c* is formed in the regulator blade 42 by the above-described abrasion device, after which a grindstone roller whose external diameter is greater than that of the development roller 40 scrapes the flat area 42*c*-2 to form first multiple grooves S1 and second multiple grooves S2.

It is to be noted that the angle A between the first set of grooves S1 and the surface movement direction C of the development roller 40 and the angle B between the second set of grooves S2 and the surface movement direction C of the development roller 40 may be either identical or different.

In the present embodiment, since the surface of the flat area 42*c*-2 is roughened by forming the multiple grooves S1 and S2 that intersect each other, flow of the toner passing though the pressing portion between the regulator blade 42-2 and the development roller 40 may be disturbed. As a result, the number of contacts between the toner and the regulator blade 42-2 or the development roller 40 is increased, and the charging ability of the toner is increased, which prevents the occurrence of imaging failures such as black spots on the background of the image.

Herein, when the print durability test using the regulator blade 42-2 according to the present embodiment was measured under conditions of high temperature and high humidity, the image having high quality can be obtained without occurrence of black spots.

Figure 9B:
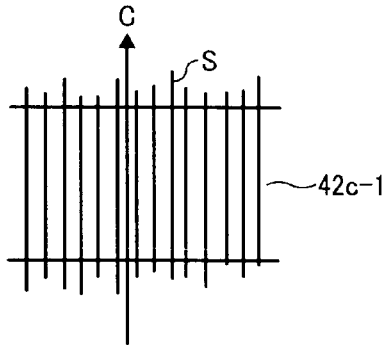
FIG. 9B is an enlarged view illustrating a main portion of the regulator blade shown in FIG. 9A.

In addition, similarly to the second embodiment of FIGS. 9A and 9B, since the surface of the flat area 42*c*-2 is roughened in the present embodiment, retaining the small toner particles and additives can be prevented, which can avoid the small toner particles and additives from adhesion.

In addition, in the present embodiment, differing from a comparative example in which the regulator blade contacts a development roller at a point (instead of in a line or over a two-dimensional area), the regulator blade 42-2 linearly contacts the development roller 40 because the surface of the flat area 42*c*-2 of the redirection blade 42-2 is roughened by forming the grooves, which can have greater resistance to abrasion of the regulator blade 42-2.

As described above, in the above-described embodiments, since the flat are is formed in the intermediate portion of the regulator blade, the abrasion on the regulator blade is minimized, and the toner layer on the development roller can be maintained at a predetermined thickness. Further, since it is not necessary to reduce the contact pressure between the regulator blade and the development roller so as to minimize abrasion of the regulator blade, a preferred charging ability can be maintained, which prevents the occurrence of imaging failures such as black spots on the background of the image.

The present invention has been described above with reference to specific example embodiments. Nonetheless, the present invention is not limited to the details of example embodiments described above, but various modifications and improvements are possible without departing from the spirit and scope of the present invention.

In addition, the material and shape of the developer regulator are not limited to the above-described embodiments, and various modifications and improvements in the material and shape of the developer regulator are possible without departing from the spirit and scope of the present invention.

It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A developer regulator to restrict an amount of a developer, the developer regulator comprising:

a base portion;

an intermediate portion including a first face, a second face opposite the first face, and a first end which is continuous with the base portion, the intermediate portion having a flat area on the first face, the flat area having a roughened surface; and a distal end continuous with a second end of the intermediate portion, the distal end being bent relative to the base portion in a direction opposite the first face of the intermediate portion on which the flat area is formed, wherein the flat area extends on the first face between a first point at the first end of the intermediate portion and a second point at the second end of the intermediate portion, wherein a distance between the first point and the second point on the first face of the intermediate portion is greater than a distance between a first point on the second face at the first end of the intermediate portion and a second point on the second face at the second end of the intermediate portion, and wherein a thickness between the first point on the first face of the intermediate portion and the first point on the second face of the intermediate portion is greater than a thickness between the first face of the intermediate portion and the second face of the intermediate portion at the second point of the second face in a direction parallel to a line between the first point on the first face of the intermediate portion and the first point on the second face of the intermediate portion.

2. The developer regulator according to claim 1, wherein the roughened surface of the intermediate portion comprises multiple parallel grooves extending in a connection direction between the base portion and the distal end.

3. The developer regulator according to claim 1, wherein the roughened surface of the flat area of the intermediate portion comprises a first set of multiple grooves and second set of multiple grooves that intersects the first set of multiple grooves.

4. A development device to develop a latent image on an image carrier with developer, the development device comprising:

a development bearer to bear and transport the developer to the image carrier; and a developer regulator, provided at a position facing the development bearer, to restrict the amount of the developer borne on the developer bearer, the developer regulator comprising:

a base portion;

an intermediate portion including a first face, a second face opposite the first face, and a first end which is continuous with the base portion, the intermediate portion having a flat area on the first face facing the surface of the developer bearer, the flat area having a roughened surface; and a distal end continuous with a second end of the intermediate portion, the distal end being bent relative to the base portion in a direction opposite the first face of the intermediate portion on which the flat area is formed, wherein the flat area extends on the first face between a first point at the first end of the intermediate portion and a second point at the second end of the intermediate portion, wherein a distance between the first point and the second point on the first face of the intermediate portion is greater than a distance between a first point on the second face at the first end of the intermediate portion and a second point on the second face at the second end of the intermediate portion, and wherein a thickness between the first point on the first face of the intermediate portion and the first point on the second face of the intermediate portion is greater than a thickness between the first face of the intermediate portion and the second face of the intermediate portion at the second point of the second face in a direction parallel to a line between the first point on the first face of the intermediate portion and the first point on the second face of the intermediate portion.

5. The development device according to claim 4, wherein the roughened surface of the flat area of the developer regulator comprises multiple parallel grooves extending in a direction in which the surface of the development bearer is moved.

6. The development device according to claim 4, wherein the roughened surface of the flat area of the developer regulator comprises a first set of multiple grooves and second set of multiple grooves that intersects the first set of multiple grooves.

7. The development device according to claim 4, wherein the flat area abuts the developer bearer.

8. An image forming apparatus, comprising:

an image carrier to bear a latent image; and a development device to develop the latent image on the image carrier with developer, the development device comprising:

a development bearer to bear and transport the developer to the image carrier; and a developer regulator, provided at a position facing the development bearer, to restrict the amount of developer borne on the developer bearer, the developer regulator comprising:

a base portion;

an intermediate portion including a first face, a second face opposite the first face, and a first end which is continuous with the base portion, the intermediate portion having a flat area on the first face, the flat area having a roughened surface; and a distal end continuous with a second end of the intermediate portion, the distal end being bent relative to the base portion in a direction opposite the first face of the intermediate portion on which the flat area is formed, wherein the flat area extends on the first face between a first point at the first end of the intermediate portion and a second point at the second end of the intermediate portion, wherein a distance between the first point and the second point on the first face of the intermediate portion is greater than a distance between a first point on the second face at the first end of the intermediate portion and a second point on the second face at the second end of the intermediate portion, and wherein a thickness between the first point on the first face of the intermediate portion and the first point on the second face of the intermediate portion is greater than a thickness between the first face of the intermediate portion and the second face of the intermediate portion at the second point of the second face in a direction parallel to a line between the first point on the first face of the intermediate portion and the first point on the second face of the intermediate portion.

9. The image forming apparatus according to claim 8, wherein the roughened surface of the flat area of the developer regulator comprises multiple parallel grooves extending in a direction in which the surface of the development bearer is moved.

10. The image forming apparatus according to claim 8, wherein the roughened surface of the flat area of the developer regulator comprises a first set of multiple grooves and a second set of multiple grooves that intersects the first set of multiple grooves.

11. The image forming apparatus according to claim 8, wherein the flat area abuts the developer bearer.

* * * * *